US009586749B2

(12) United States Patent
Schultz

(10) Patent No.: US 9,586,749 B2
(45) **Date of Patent: *Mar. 7, 2017**

(54) EYE SHIELD LENS DISPENSER TRAY

(71) Applicant: TIDI Products, LLC, Neenah, WI (US)

(72) Inventor: Bradly Thomas Schultz, Greenville, WI (US)

(73) Assignee: TIDI Products, LLC, Neenah, WI (US)

( * ) Notice: Subject to any disclaimer, the term of this patent is extended or adjusted under 35 U.S.C. 154(b) by 28 days.

This patent is subject to a terminal disclaimer.

(21) Appl. No.: 14/672,366

(22) Filed: Mar. 30, 2015

(65) Prior Publication Data

US 2015/0266656 A1 Sep. 24, 2015

Related U.S. Application Data

(63) Continuation of application No. 14/264,224, filed on Apr. 29, 2014, now Pat. No. 8,991,686.

(60) Provisional application No. 61/817,411, filed on Apr. 30, 2013.

(51) Int. Cl.
*B65D 83/08* (2006.01)
*B65D 81/38* (2006.01)

(52) U.S. Cl.
CPC ..... *B65D 83/0876* (2013.01); *B65D 81/3813* (2013.01); *B65D 2501/00* (2013.01)

(58) Field of Classification Search
USPC ..... 229/100, 241, 243, 244
See application file for complete search history.

(56) References Cited

U.S. PATENT DOCUMENTS

| | | | | |
|---|---|---|---|---|
| 3,265,283 | A | 8/1966 | Farquhar | |
| 4,752,029 | A | 6/1988 | Buford | |
| 4,946,042 | A * | 8/1990 | Ferreri et al. | 229/241 |
| 5,249,737 | A | 10/1993 | Fritz et al. | |
| 5,284,293 | A * | 2/1994 | Alpern | A61B 17/06133 206/63.3 |
| 5,425,474 | A * | 6/1995 | Dalea | B65D 5/725 206/499 |
| 5,836,478 | A | 11/1998 | Weiss | |
| 6,253,930 | B1 | 7/2001 | Freidus et al. | |
| 6,510,982 | B2 * | 1/2003 | White et al. | 229/235 |
| 7,648,048 | B2 | 1/2010 | Smith | |
| 7,658,317 | B2 | 2/2010 | Wilkins | |
| 8,136,697 | B2 | 3/2012 | Hackney | |
| 8,328,079 | B2 * | 12/2012 | Kohler | 229/244 |
| 8,485,423 | B2 | 7/2013 | Thomas et al. | |
| 8,991,686 | B2 | 3/2015 | Schultz | |
| 2005/0199690 | A1 * | 9/2005 | Peterson | B65D 5/0254 229/122.1 |
| 2007/0152028 | A1 | 7/2007 | McGowan | |
| 2014/0318084 | A1 | 10/2014 | Schultz | |
| 2014/0319205 | A1 | 10/2014 | Schultz | |

* cited by examiner

*Primary Examiner* — Christopher Demeree
(74) *Attorney, Agent, or Firm* — Boyle Fredrickson, S.C.

(57) ABSTRACT

The present invention provides a dispenser tray for eye shield lenses made from a single blank of material. The dispenser tray and blank each include a top panel, a front panel, a first side panel, a second side panel and a bottom panel.

20 Claims, 2 Drawing Sheets

EYE SHIELD LENS DISPENSER TRAY

CROSS-REFERENCE TO RELATED APPLICATIONS

The present application is a continuation of U.S. patent application Ser. No. 14/264,224, filed Apr. 29, 2014, which claims the benefit of U.S. Provisional Application No. 61/817,411, filed Apr. 30, 2013, the contents of which are incorporated herein by reference.

FEDERALLY SPONSORED RESEARCH OR DEVELOPMENT

N/A

TECHNICAL FIELD

The present invention generally relates to a dispenser for lenses for eye shields. The eye shields can be used in connection with medical, dental, or other applications.

BACKGROUND OF THE INVENTION

Healthcare professionals often use disposable eye shields to prevent splatter of bodily fluids such as spittle and blood from entering the eyes to prevent potential infections. Healthcare professionals need to be able to have quick and ready access to such eye shields. Often, the lenses are stored separately from the frames. The present invention provides storage and dispensing access to eye shield lenses.

SUMMARY OF THE INVENTION

The present invention provides a dispenser tray for eye shield lenses made from a single blank of material. A blank includes a top panel and a front panel attached to the top panel along a first fold line. The front panel includes at least one edge tab at an outer edge and a pair of slots spaced along the first fold line. The front panel also includes first and second tabs attached along second and third fold lines. The blank also includes a first side panel attached to the top panel along a fourth fold line, and a first front flap attached to the first side panel along a fifth fold line and a slot located along the fifth fold line. A first back flap is attached to the first side panel along a sixth fold line. A second back flap is attached to the top panel along a seventh fold line. A first back tab is attached along an eighth fold line to the first back flap. A second side panel is attached to the top panel along a ninth fold line. A third back flap is attached to the second side panel along a tenth fold line. A second front flap is attached to the second side panel along an eleventh fold line. A slot is located along the eleventh fold line.

A bottom panel is attached to the second side panel along a twelfth fold line. A detachable panel is attached to the bottom panel along a thirteenth perforated fold line. The detachable panel includes at its outer edge a first tab attached to the outer edge along a fold line. A fourth back flap is attached along a fourteenth fold line to the bottom panel. A second back tab is attached along a fifteenth fold line to the fourth back flap. A glue panel is attached to the bottom panel along a sixteenth fold line. In another embodiment, the second and third fold lines attaching first and second tabs to the front panel each include a notched portion.

BRIEF DESCRIPTION OF THE DRAWINGS

To understand the present invention, it will now be described by way of example, with reference to the accompanying drawings in which.

DETAILED DESCRIPTION

Figure 1:
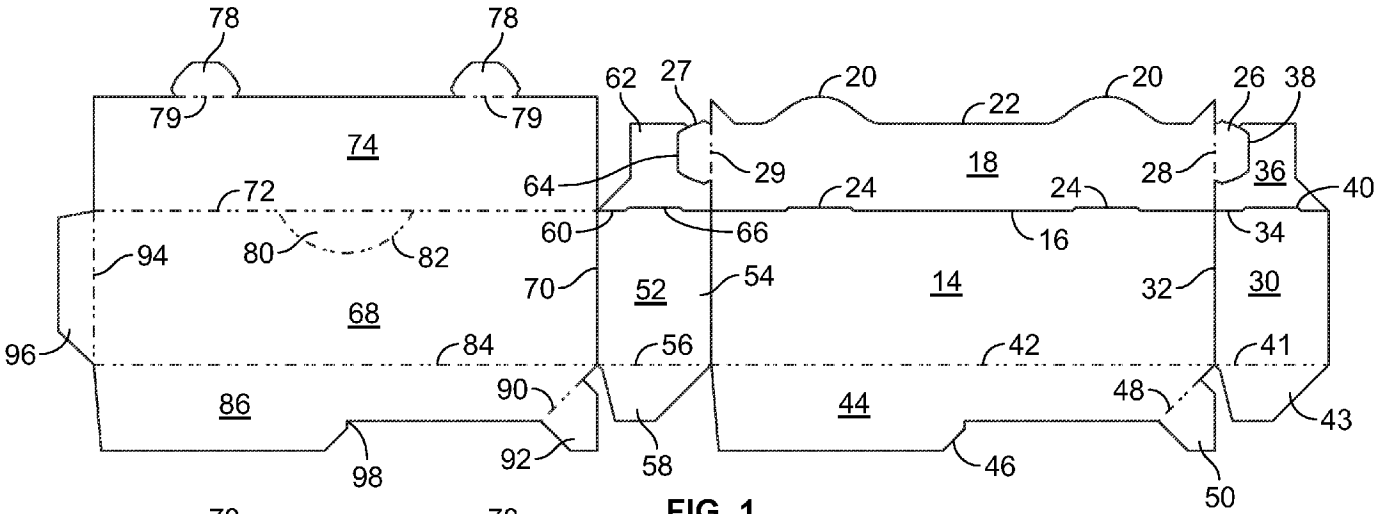
FIG. 1 is a top plan view of a blank for forming a dispenser tray made in accord with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the FIGS., a blank 10 for constructing the dispenser tray 12 of the present invention is provided in FIG. 1. The tray 12 is preferably constructed from a single blank 10 of material such as cardboard or plastic, although, any suitable material may be used. The blank 10 includes a top panel 14. Attached to the top panel 14 along a first fold line 16 is a front panel 18. The front panel 18 includes a pair of edge tabs 20 at an outer edge 22. A pair of slots 24 is spaced along the first fold line 16. The front panel 18 includes first and second tabs 26 and 27 attached along second and third fold lines 28 and 29.

A first side panel 30 is attached to the top panel 14 along a fourth fold line 32. Attached to the first side panel 30 along a fifth fold line 34 is a first front flap 36. First front flap 36 and tab 26 are detachably connected along a first cut line 38. A slot 40 is located along fifth fold line 34. Attached to the first side panel 30 along a sixth fold line 41 is a first back flap 43.

Attached along a seventh fold line 42 to top panel 14 is a second back flap 44. The second back flap 44 includes a stepped portion 46. Attached along an eighth fold line 48 to the first back flap 44 is a first back tab 50.

A second side panel 52 is attached along a ninth fold line 54 to the top panel 14. Attached to the second side panel 52 along a tenth fold line 56 is a third back flap 58. Attached to the second side panel 52 along an eleventh fold line 60 is a second front flap 62. Second front flap 62 and second tab 27 are detachably connected along a second cut line 64. A slot 66 is located along the eleventh fold line 60.

A bottom panel 68 is attached along a twelfth fold line 70 to the second side panel 52. Attached to the bottom panel 68 along a thirteenth perforated fold line 72 is a detachable panel 74. The detachable panel 74 includes at its outer edge 76 a pair of tabs 78 that cooperate with slots 24 as will be described below. Tabs 78 are attached to the outer edge 76 along fold lines 79. The bottom panel 68 also includes a cutout 80 formed by perforated line 82.

Attached along a fourteenth fold line 84 to bottom panel 68 is a fourth back flap 86. The fourth back flap 86 includes a stepped portion 98 that cooperates with stepped portion 46 to form the back of the dispenser tray 12. Attached along a fifteenth fold line 90 to the fourth back flap 86 is a second back tab 92. Attached to the bottom panel 68 along a sixteenth fold line 94 is a glue panel 96.

Figure 5:
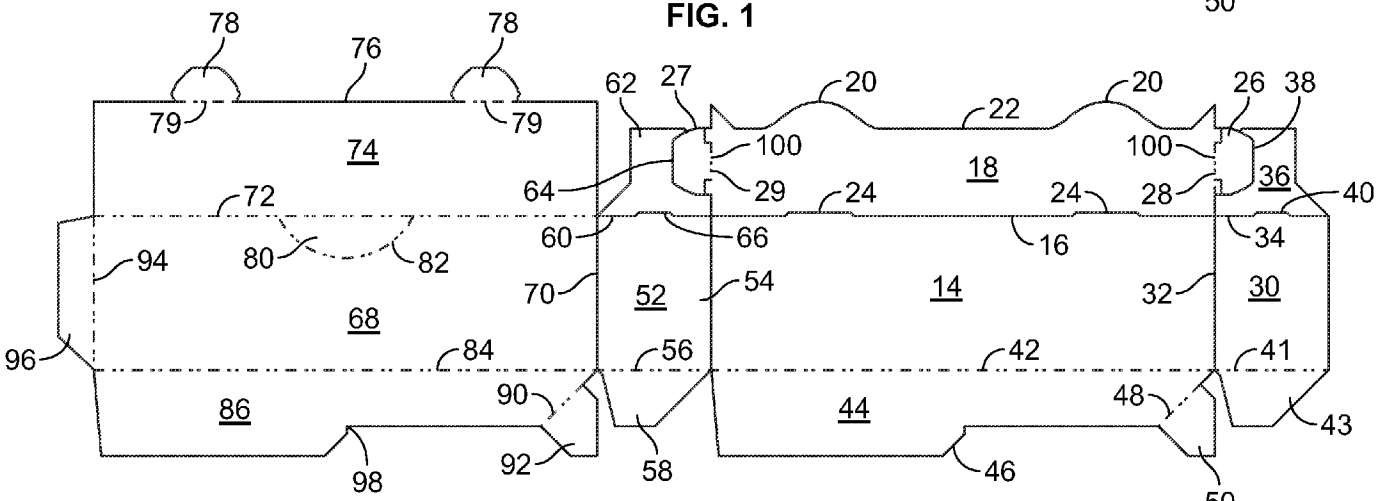
FIG. 5 is a top plan view of a blank for forming a dispenser tray made in accord with the present invention

The embodiment shown in FIG. 5 is very similar to that of FIG. 1. However, in FIG. 5, tabs 26 and 27 are slightly smaller than the embodiment of FIG. 1. Moreover, the second and third fold lines 28 and 29 attaching first and second tabs 26 and 27 to the front panel 18 each include a notched portion 100.

To construct the dispenser tray 12, the first side panel 30, top panel 14, second side panel 52, and bottom panel 68 are folded inward along fold lines 32, 54, and 70. The first tab 26 and second tab 27 and are separated along cut lines 38 and 64, respectively. First tab 26 is folded inwardly along fold line 28 and second tab 27 is folded inwardly along fold line 29. First front flap 36 is folded inwardly along fold line 34. Second front flap 62 is folded inwardly along fold line 60. Front panel 18 is folded inwardly along fold line 16. Detachable panel 74 is folded inwardly along fold line 72. Second and fourth back flaps 44 and 86 are folded inwardly along fold lines 42 and 84. First and third back flaps 43 and 58 are folded inwardly along fold lines 41 and 56. First and second back tabs 50 and 92 are folded inwardly along fold lines 48 and 90. Glue panel 96 is folded inwardly along fold line 94.

The first, second, third, and fourth back flaps 43, 44, 58 and 86, and first and second back tabs 50 and 92 auto-erect to form a back wall 98 of the tray 12. The second and fourth back flaps 44 and 86 meet such that the stepped portions 46 and 88 intersect. First and second back tabs 50 and 92 are glued to the inner surfaces of the second and fourth back flaps 44 and 86. First and third back flaps 43 and 58 are glued to the inner surface of the first and second back tabs 50 and 92.

Figure 2:
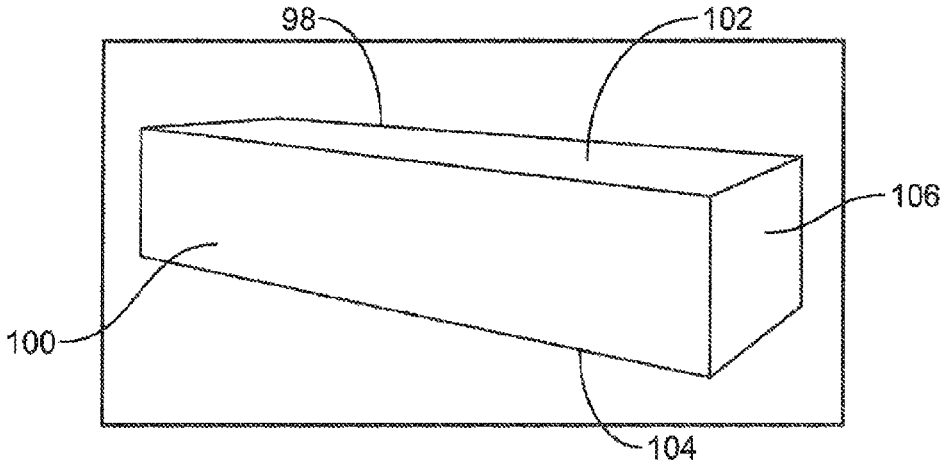
FIG. 2 is a perspective front view of a dispenser tray including a removable front wall formed by a detachable panel in accord with the present invention.

First and second front flaps 36 and 62 are folded inwardly until substantially perpendicular to top panel 14, as is front panel 18. Tab 26 is inserted into slot 40. Tab 27 is inserted into slot 66. Tabs 78 are inserted into slots 24. Glue panel 96 is glued to the inner surface of the first side panel 30. This is a closed position for the tray 12 as shown in FIG. 2. When constructed the dispenser tray 12 includes the back wall 98 described above, a removable front wall 100 formed by the detachable panel 74, a top wall 102 formed by top panel 14, a bottom wall 104 formed by the bottom panel 68, and side walls 106 formed by first and second side panels 30 and 52.

Figure 3:
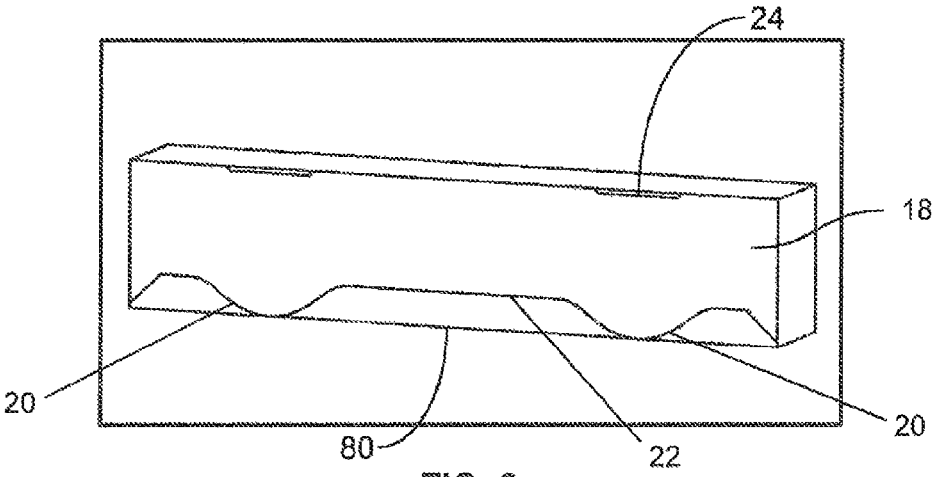
FIG. 3 is a perspective front view of the dispenser tray of FIG. 2 with the detachable panel removed to expose a front panel in accord with the present invention.
Figure 4:
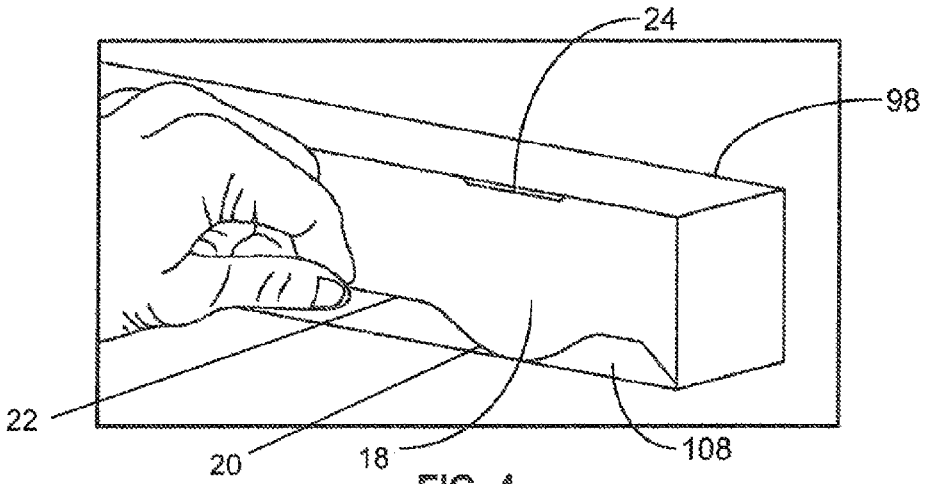
FIG. 4 is a perspective view showing lenses being dispensed from a dispenser view in accord with the present invention.

For use, the detachable panel 74 is removed along perforations 72 and 82, and the tabs 78 removed from slots 24. The dispenser tray 12 is shown in FIG. 3 with the detachable panel 74 removed, exposing the front panel 18, and creating cutout 80 in the bottom panel 68. Cutout 80 allows better access to lenses 108 within the tray 12 (FIG. 4). Tabs 20 retain the lenses within the tray 12 until removed by the user. The tray 12 can be mounted on a wall or in a holder (not shown) such that the tray 12 can be easily replaced when the supply of glasses or frames therein is exhausted.

While the specific embodiments have been illustrated and described, numerous modifications come to mind without significantly departing from the spirit of the invention, and the scope of protection is only limited by the scope of the accompanying Claims.

What is claimed is:

1. A dispenser tray comprising:

a first side wall, a second side wall, a top wall, a bottom wall and a back wall;

a front panel connected to the top wall, the front panel having a lower edge forming a product removal slot between the lower edge of the front panel and the bottom wall for removal of product in the interior of the tray;

a first tab extending downward from the lower edge of the front panel toward the bottom wall to hold the product in place prior to withdrawal through the product removal slot; and a detachable panel positioned to cover the front panel and the product removal slot, the detachable panel being completely removable, wherein the detachable panel is connected to the bottom wall along a perforated fold line.

2. The dispenser tray of claim 1 comprising a second tab spaced from the first tab, the second tab extending downward from the lower edge of the front panel toward the bottom wall.

3. The dispenser tray of claim 1 comprising a first tab slot proximate a top edge of the front panel.

4. The dispenser tray of claim 3 wherein the detachable panel includes a first tab aligned for placement in the first tab slot.

5. The dispenser tray of claim 4 comprising a second tab slot proximate the top edge of the front panel spaced from the first tab slot, and a second tab on the detachable panel aligned for placement in the second tab slot.

6. The dispenser tray of claim 3 wherein the detachable panel is connected to the bottom wall by a perforated line.

7. The dispenser tray of claim 1 wherein the bottom wall includes a cutout.

8. The dispenser tray of claim 7 wherein the cutout has a semi-circular shape.

9. The dispenser tray of claim 1 wherein each of the walls is formed from a single blank of material.

10. A blank for forming a dispenser tray comprising:

a single piece of material having a plurality of fold lines forming a bottom wall panel, a first side wall panel, a second side wall panel, a top wall panel, a back wall panel and a front panel;

a first tab extending from an outer edge of the front panel; and a detachable cover panel connected to the bottom wall panel along a perforated fold line, the detachable cover panel being completely removable, wherein the blank is configured to fold along the plurality of fold lines to form a dispenser tray having a product removal slot between the outer edge and the bottom wall panel, wherein the detachable cover is positioned to cover the front panel and the product removal slot.

11. The blank for forming a dispenser tray of claim 10 comprising a second tab connected to the outer edge of the front panel spaced from the first tab.

12. The blank for forming a dispenser tray of claim 11 wherein the detachable cover panel includes a first tab and a second tab extending outward from an edge of the detachable cover panel.

13. The blank for forming a dispenser tray of claim 12 wherein the front panel is integrally connected to the back wall panel by a first one of the plurality of fold lines.

14. The blank for forming a dispenser tray of claim 13 wherein the first one of the plurality of fold lines includes a first slot aligned with the first tab of the detachable cover panel and a second slot aligned with the second tab of the detachable cover panel.

15. The blank for forming a dispenser tray of claim 10 wherein the back wall panel comprises a first back wall panel section and a second back wall panel section.

16. The blank for forming a dispenser tray of claim 15 wherein the first back wall panel section includes a first glue tab and the second back wall panel section includes a second glue tab.

17. A dispenser comprising:

a first side wall, a second side wall, a top wall, a bottom wall and a back wall;

a front wall connected to the top wall;

a detachable panel positioned proximate to the front wall, the detachable panel being completely removable from the front wall to expose an edge forming a product removal slot in the front wall for removal of eye shield products from the interior of the dispenser; and a first tab extending from the front wall toward the product removal slot, the first tab being operable to hold at least a portion of the eye shield products in place prior to withdrawal through the product removal slot, wherein the detachable panel is connected to at least one wall by a perforated fold line.

18. The dispenser of claim 17 further comprising a second tab spaced from the first tab, the second tab being operable to hold at least a portion of the eye shield products in place prior to withdrawal through the product removal slot.

19. The dispenser of claim 17 wherein each of the walls is formed from a single blank of material.

20. The dispenser of claim 19 wherein the dispenser is formed from cardboard.

* * * * *